US007543338B2

(12) United States Patent
Culhane

(10) Patent No.: US 7,543,338 B2
(45) Date of Patent: Jun. 9, 2009

(54) GARMENTS WITH STRETCH FABRICS

(75) Inventor: Steven Culhane, Sidney, NE (US)

(73) Assignee: Cabela's Inc., Sidney, NE (US)

( * ) Notice: Subject to any disclaimer, the term of this patent is extended or adjusted under 35 U.S.C. 154(b) by 928 days.

(21) Appl. No.: 10/687,228

(22) Filed: Oct. 16, 2003

(65) Prior Publication Data

US 2004/0078865 A1 Apr. 29, 2004

(51) Int. Cl.
*A41D 1/02* (2006.01)

(52) U.S. Cl. ..... 2/93; 2/97

(58) Field of Classification Search ..... 2/69, 2/77, 78.3, 84, 85, 87, 93, 94, 96–97, 102, 2/108, 113, 115, 904
See application file for complete search history.

(56) References Cited

U.S. PATENT DOCUMENTS 890,792 A * 6/1908 Peine ..... 2/227
2,002,955 A * 5/1935 Lipson ..... 2/84
2,264,314 A * 12/1941 Johns ..... 2/84
2,554,361 A * 5/1951 Ettien et al. ..... 2/93
2,643,385 A * 6/1953 Engel ..... 2/108
2,664,570 A * 1/1954 Artzt ..... 2/78.3
2,682,056 A * 6/1954 Werber ..... 2/84
2,986,740 A * 6/1961 Schudson ..... 2/115
3,086,214 A * 4/1963 Lash ..... 2/79
3,311,926 A * 4/1967 Gerber ..... 2/128
3,335,425 A * 8/1967 Senser ..... 2/96
3,761,962 A * 10/1973 Myers ..... 2/79
3,771,169 A * 11/1973 Edmund ..... 2/2.17
3,921,224 A * 11/1975 Ingram, III ..... 2/93
4,371,989 A * 2/1983 Polsky ..... 2/227
D271,154 S * 11/1983 Dowling ..... D2/847
4,422,184 A * 12/1983 Myers ..... 2/4
4,488,317 A * 12/1984 Polsky ..... 2/227
4,608,716 A * 9/1986 Brumfield ..... 2/2.5
4,665,563 A * 5/1987 Harvey ..... 2/87
4,722,099 A * 2/1988 Kratz ..... 2/79
5,031,242 A * 7/1991 Aldridge et al. ..... 2/81
5,097,535 A * 3/1992 Dye et al. ..... 2/69
5,163,183 A * 11/1992 Smith ..... 2/81
5,168,580 A * 12/1992 Foo ..... 2/115
5,182,812 A * 2/1993 Goldsby ..... 2/79
5,367,708 A * 11/1994 Fujimoto ..... 2/22
5,369,809 A * 12/1994 Hall ..... 2/202
5,488,738 A * 2/1996 Seamans ..... 2/69
5,593,754 A * 1/1997 Blauer et al. ..... 428/131
RE35,436 E * 2/1997 Grilliot et al. ..... 2/93
5,608,913 A * 3/1997 Lacoste ..... 2/115
5,631,074 A * 5/1997 Herlihy, Jr. ..... 442/35
5,799,328 A * 9/1998 Harlem et al. ..... 2/69
5,807,293 A * 9/1998 Wedge, Jr. ..... 602/21
5,845,336 A * 12/1998 Golde ..... 2/93
5,918,314 A * 7/1999 Moses ..... 2/79
5,918,319 A * 7/1999 Baxter ..... 2/455
6,052,826 A * 4/2000 Tolton ..... 2/87

(Continued)

*Primary Examiner*—Alissa L Hoey
(74) *Attorney, Agent, or Firm*—Bachman & LaPointe, P.C.

(57) ABSTRACT

The present invention relates to various types of garments to be worn by outdoors people such as hunters and fishermen. The garments include stretch fabric portions in strategic locations to provide mobility as well as comfort and thereby allow the wearer to engage in a wide range of activities. The garments having such stretch fabric portions include pants-type garments, bib overall type garments, and coat-type garments and coverall-type garments.

13 Claims, 3 Drawing Sheets

U.S. PATENT DOCUMENTS 6,076,187 A * 6/2000 Wallerstein ..... 2/115
6,098,198 A * 8/2000 Jacobs et al. ..... 2/69
6,279,161 B1 * 8/2001 Johnston ..... 2/69
6,298,485 B1 * 10/2001 Heller ..... 2/70
6,349,413 B1 * 2/2002 Rose et al. ..... 2/126
6,438,755 B1 * 8/2002 MacDonald et al. ..... 2/69
6,477,712 B1 * 11/2002 Jones ..... 2/69
D526,467 S * 8/2006 Kent ..... D2/828
7,117,537 B2 * 10/2006 Mazzarolo ..... 2/69
2003/0051286 A1 * 3/2003 Gregg ..... 2/93

* cited by examiner

GARMENTS WITH STRETCH FABRICS

CROSS-REFERENCE TO RELATED APPLICATION(S)

This application claims the benefit of U.S. Provisional Patent Application No. 60/280,878, filed Apr. 2, 2001, entitled GARMENTS WITH STRETCH FABRICS.

BACKGROUND OF THE INVENTION

The present invention relates to garments to be worn by outdoors people, such as hunters and fishermen, which provide comfort and most importantly mobility. The garments include portions formed from stretch fabrics.

Outdoorsmen, such as hunters and fishermen, frequently find themselves in situations which require extreme mobility. For example, an outdoorsmen may find it necessary to climb a tree. A hunter may find himself or herself in a position where they need mobility in their clothing to allow them to swing a rifle or pull a bow string. Fishermen may find themselves in a position where they need mobility to cast a fishing line. Clothes worn by hunters and fishermen today lack the required mobility.

SUMMARY OF THE INVENTION

Accordingly, it is an object of the present invention to provide garments which have a high degree of mobility in areas where mobility is needed.

It is a further object of the present invention to provide garments which are comfortable to wear.

It is yet a further object of the present invention to provide garments of a type which can be worn by both men and women.

The foregoing objects are attained by the garments of the present invention.

In accordance with a first embodiment of the present invention, a garment is provided which comprises first and second leg portions with each of the leg portions having an articulated knee portion and a hinged knee portion. Both the articulated knee portion and the hinged knee portion are formed from a stretch material, wherein the stretch material forming the articulated knee portion has a longer span than the stretch material forming the hinged knee portion. The garment further has a seat portion formed from a stretch material. The garment may comprise pants or a bib overall.

In a second embodiment of the present invention, a garment is provided which has a body portion and two arm portions extending from the body portion with each arm portion having an elbow portion formed from a stretch material. The body portion has a rear portion which is also formed from a stretch fabric material. Still further, the garment includes under arm portions formed from a stretch fabric material.

Other details of the garments of the present invention, as well as other objects and advantages attendant thereto, are set forth in the following description and the accompanying drawings wherein like reference numerals depict like elements.

BRIEF DESCRIPTION OF THE DRAWING(S)

DETAILED DESCRIPTION OF THE PREFERRED EMBODIMENT(S)

Figure 1:
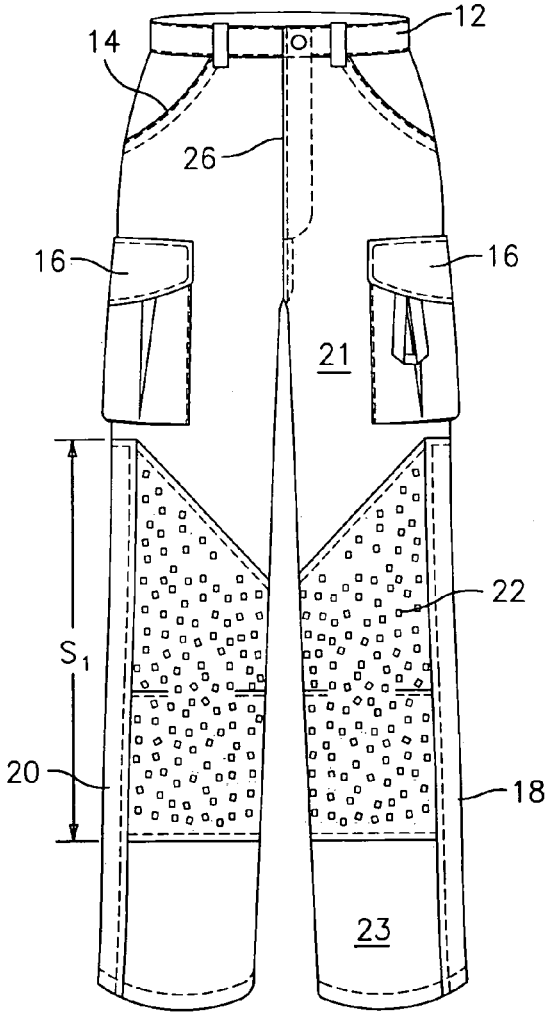
FIG. 1 is a front view of a pants garment formed in accordance with the present invention.
Figure 2:
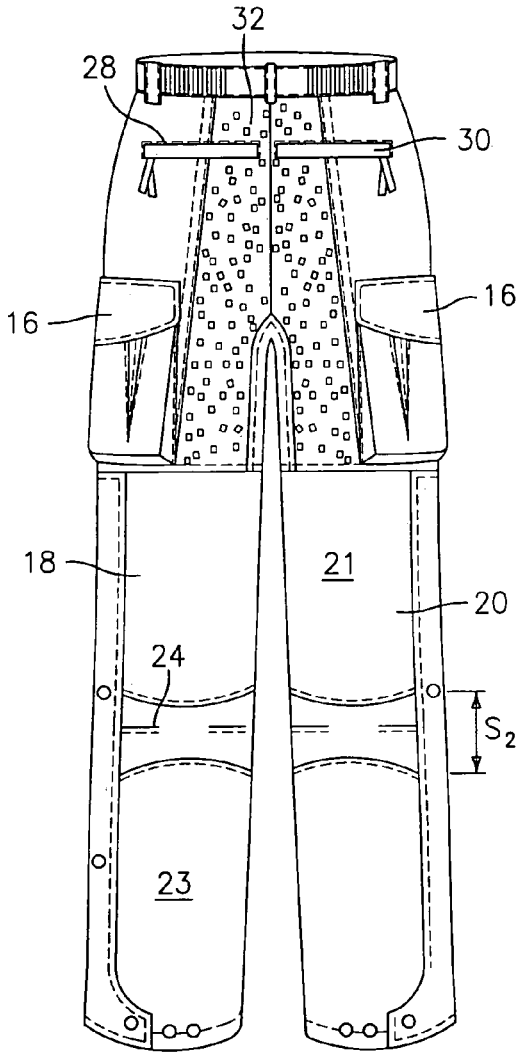
FIG. 2 is a rear view of the pants garment of FIG. 1.

Referring now to the drawings, FIGS. 1 and 2 illustrate a pants garment 10 formed in accordance with the present invention. The pants garment 10 includes a waist portion 12, front pockets 14 and 16, rear pockets 28 and 30, and legs 18 and 20 having an articulated knee portion 22 and a hinge knee portion 24. The pants garment 10 also includes an opening 26 in the front of the garment 10. The opening 26 may be closed by any suitable means known in the art, such as a zipper, snaps, buttons, and/or VELCRO pieces. Still further, the pants garment 10 includes a seat portion 32. The waist portion 12 may contain an elastic material and a snap- or hook-type closure for allowing a tight fit around a user's waist.

As previously discussed, outdoorsmen often find themselves in situations where it is necessary to climb trees or fences or otherwise jump over or hurdle terrain features. In order to allow the user freedom to accomplish these tasks and others, the pants garment 10 must provide mobility as well as comfort. To this end, the articulated knee portion 22 and/or the hinged knee portion 24 are formed from a stretch fabric material. As can be seen from FIGS. 1 and 2, when both the articulated knee portion 22 and the hinged knee portion 24 are both formed from a stretch fabric material, it is preferred that the stretch fabric material forming the articulated knee portion 22 has a larger span $S_1$ than the stretch fabric material forming the hinged knee portion 24. This is to allow a greater range of stretching in the front where it is needed. In the rear of the garment 10, the knee portion 24 primarily acts as a hinge and thus, a smaller span $S_2$ of stretch fabric material is needed for this portion. Remaining portions of the legs, such as upper leg portions 21 and lower leg portions 23, are preferably formed from a non-stretch or stable fabric material.

In addition to the knee portions 22 and 24 being formed from a stretch fabric material, the seat portion 32 of the pants garment 10 is formed from a stretch fabric material. This provides added mobility during bending.

The stretch fabric material used to form the knee portions 22 and 24 and the seat portion 32 may be any suitable stretch fabric material known in the art, such as a SPANDEX fabric material.

Figure 3:
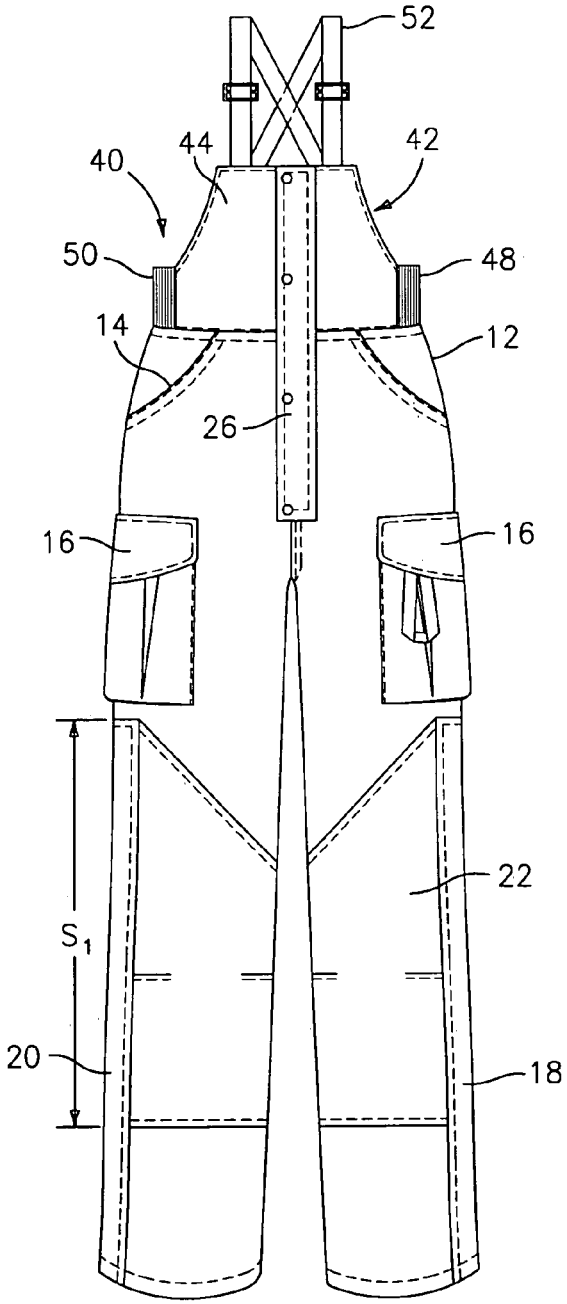
FIG. 3 is a front view of a bib overall garment formed in accordance with the present invention.
Figure 4:
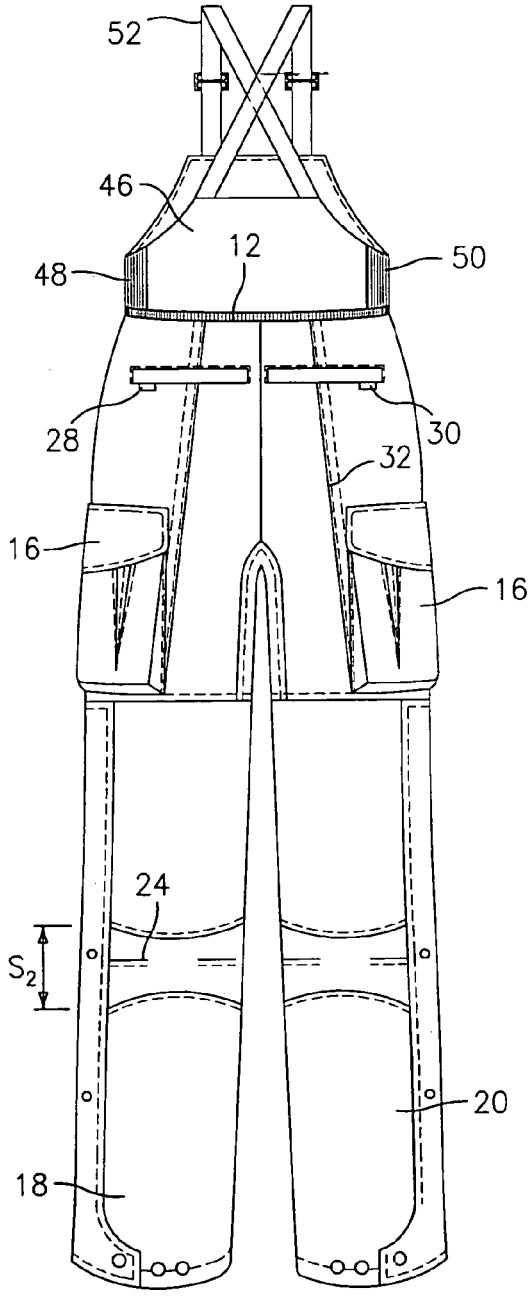
FIG. 4 is a rear view of the bib overall garment of FIG. 3.

Referring now to FIGS. 3 and 4, a bib overall type garment 40 is illustrated. The garment 40 is similar in construction to the pants garment 10 and includes a waist portion 12, front pockets 14 and 16, legs 18 and 20, articulated knee portion 22, hinged knee portion 24, a front opening 26, rear pockets 28 and 30, and seat portion 32. As before, the waist portion 12 is preferably elasticized and the front opening 26 has a closure such as a zipper, snaps, VELCRO pieces and/or buttons.

The bib garment 40 also has knee portions 22 and 24 and a seat portion 32 formed from a stretch fabric material and remaining portions, such as upper leg portions 21 and lower leg portions 23, formed from non-stretch or stable fabrics. In addition, the garment 40 has a bib portion 42 with front and rear panels 44 and 46 respectively. The front and rear panels 44 and 46 are joined together by side panels 48 and 50 and by straps 52. The side panels 48 and 50 may be joined to the front and rear panels 44 and 46 using any suitable means known in the art. If desired, the straps 52 may include buckle-type release devices to facilitate a user's access into and out of the garment 40. Further, the straps 52 may be variable in length and may be provided with suitable length adjustment devices.

In a preferred construction, the side panels 44 and 46 and the straps 52 are formed from a stretch fabric material. As before, the material forming the side panels 44 and 46 and the straps 52 may comprise any suitable stretch fabric material known in the art.

Figure 5:
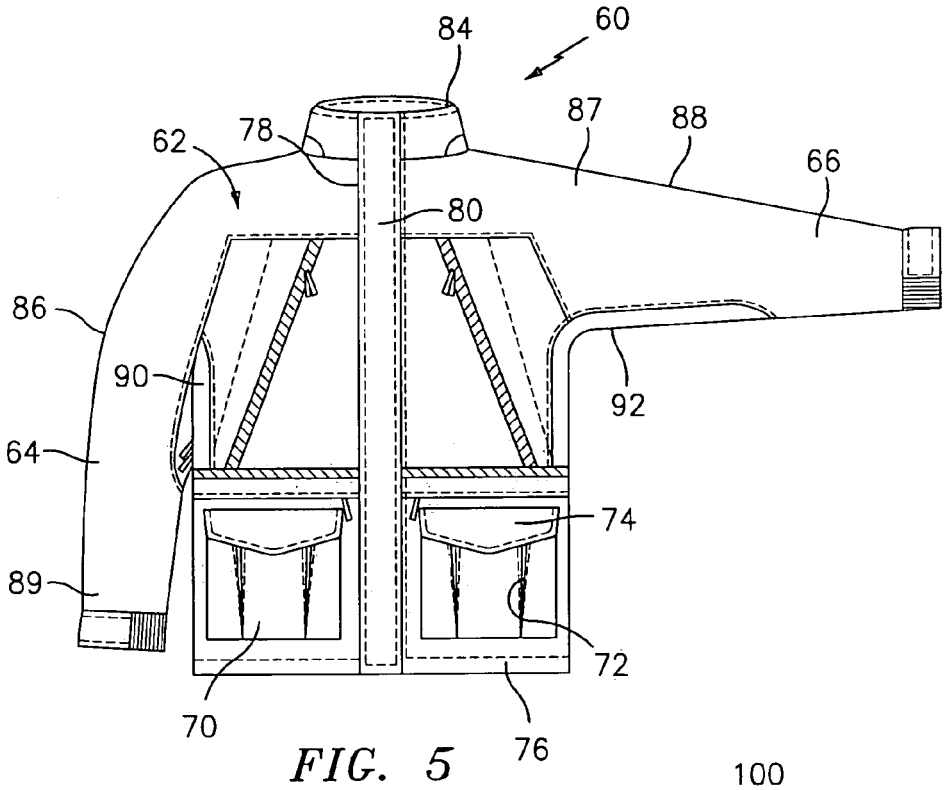
FIG. 5 is a front view of a coat formed in accordance with the present invention.
Figure 6:
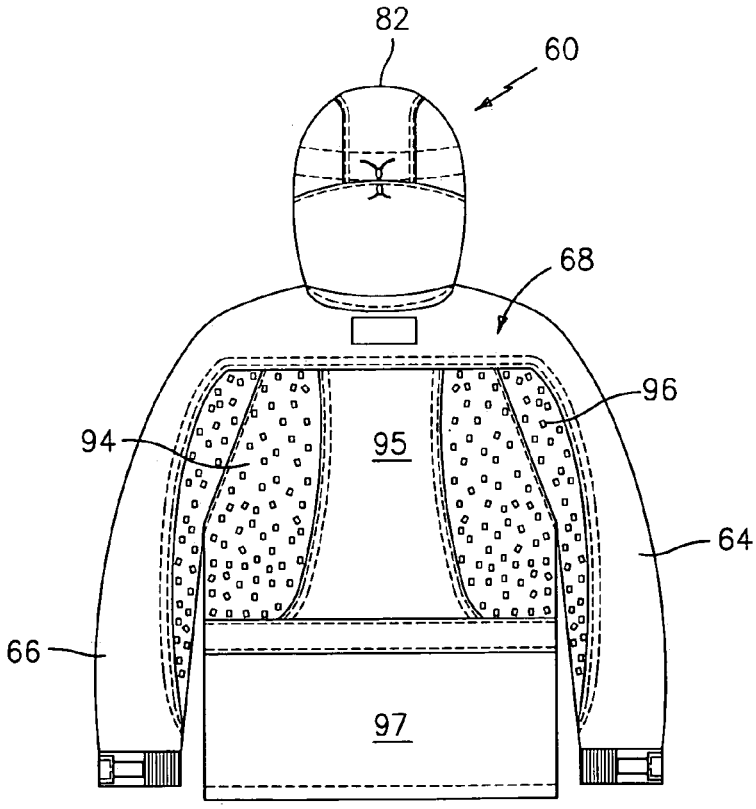
FIG. 6 is a rear view of the coat of FIG. 5.
Figure 7:
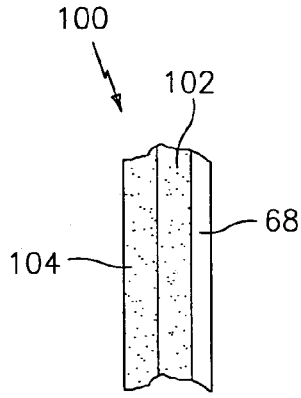
FIG. 7 is a sectional view if a portion of the coat of FIG. 5.

Referring now to FIGS. 5-7, a coat garment 60 is illustrated. The coat garment 60 includes a front portion 62, arms 64 and 66, and a rear portion 68. The coat garment 60 may include any desired number of pockets such as pockets 70 and 72. The pockets may be open pockets are pockets which are capable of being closed by a button, a zipper, VELCRO fabric pieces, snaps, or the like. If desired, the pockets 70 and 72 may have flap portions 74. The waist portion 76 of the garment 60 may have a drawstring or the like to allow this portion to be closely fitted to the user.

The garment 60 also has a front opening 78. The front opening 78 may be closed using any suitable means known in the art such as a zipper, VELCRO pieces, snaps, and/or buttons. If desired, the garment 60 may be constructed so that a piece of fabric 80 overlaps the closure device.

The garment 60 may also have a hood 82 attached to it. The hood 82 may be collapsible so that it can be stored in a neck portion 84 of the garment 60. Alternatively, the hood 82 may be detachable from the garment 60.

To provide the garment 60 with the mobility need by a user, certain portions of the garment 60 are formed from a stretch fabric material, while other portions are formed from a non-stretch or stable fabric material. For example, elbow portions 86 and 88, and under arm portions 90 and 92 of the garment 60 are formed from a stretch fabric material. Upper arm portions 87 and wrist portions 89 of the garment 60 may be formed from non-stretch or stable fabric material. Further, the rear portion 68 has first and second side panels 94 and 96 formed from a stretch fabric material, while a central portion 95 and a lower rear portion 97 are formed from a non-stretch or stable fabric material. As before, the stretch fabric material forming the elbow portions 86 and 88, underarm portions 90 and 92, and side portions 94 and 96 may comprise any suitable stretch fabric material known in the art. By providing a stretch fabric material in these portions, a user is free to engage in a wide range of activities requiring freedom of movement such as drawing a bow string or swinging a rifle or a shotgun to a desired position.

If desired, the entire rear portion 68 of the garment 60 may be formed from a stretch fabric.

If desired, the garment 60 may include a liner 100. The liner 100 may be a removable liner or a permanently affixed liner. Preferably, when present, the liner 100 is formed from a stretch fabric material such as a breathable, waterproof stretch fabric material 102. If desired, the stretch fabric material 102 could be part of a laminated construction where a stretch film material 104 is applied to one side of the stretch fabric material. Ideally, the stretch fabric material 102 would be a four way stretch fabric material.

While the garment 60 has been illustrated as being a jacket type of garment, it could also be a parka type of garment if desired.

It should be recognized that the garments described herein may be adapted and/or sized to fit men, women, and children.

Further, the stretch fabric material locations set forth hereinbefore in connection with the pants and the coat garments could be used in the construction of a single piece coverall type of garment which covers both the upper and lower portions of a human torso.

If desired, both the stretch fabric materials and the non-stretch or stable fabric materials used in the garments of the present invention may be coated or laminated with qa coating or film that make them waterproof.

It is apparent that there has been provided in accordance with the present invention garments made with stretch fabrics which fully satisfy the objects, means, and advantages set forth hereinbefore. While the invention has been described in the context of specific embodiments thereof, alternatives, modifications, and variations will become apparent to those skilled in the art having read the foregoing description. Accordingly, it is intended to embrace those alternatives, modifications, and variations as fall within the broad scope of the appended claims.

What is claimed is:

1. A coat garment to be worn by a human being comprising:
a front portion and a rear portion;
a pair of arms being joined to said front and rear portions;
each of said arms having an elbow portion formed from a stretch fabric material and other portions formed from a non-stretch fabric material;
underarm portions formed from a stretch fabric material;
said rear portion having first and second side portions and a central portion located intermediate said first and second side portions and abutting said first and second side portions;
each of said first and second side portions being formed from a stretch fabric material; and
said stretch fabric material having a stretch film material applied to a side of the stretch fabric material.

2. A coat garment according to claim 1, wherein said central portion is formed from a non-stretch fabric material.

3. A coat garment according to claim 1, wherein said stretch fabric material and said stretch film form a liner within the garment.

4. A coat garment according to claim 3, wherein said stretch fabric material is formed from a breathable waterproof stretch fabric material.

5. A coat garment according to claim 1, further comprising a hood.

6. A coat garment according to claim 5, wherein said hood is detachable from the garment.

7. A coat garment according to claim 5, wherein said hood is collapsible.

8. A coat garment according to claim 1, further comprising a lower rear portion formed from a non-stretch fabric material.

9. A coat garment according to claim 1, further comprising wrist portion of said garment being formed from non-stretch fabric.

10. A coat garment according to claim 1, wherein said stretch fabric material is a four way stretch fabric material.

11. A coat garment according to claim 1, further comprising a plurality of pockets located on said front portion of said garment.

12. A coat garment according to claim 11, further comprising a front opening and means for closing said front opening.

13. A coat garment according to claim 12, further comprising a piece of fabric overlapping said closing means.

* * * * *

UNITED STATES PATENT AND TRADEMARK OFFICE

CERTIFICATE OF CORRECTION

PATENT NO. : 7,543,338 B2
APPLICATION NO. : 10/687228
DATED : June 9, 2009
INVENTOR(S) : Culhane It is certified that error appears in the above-identified patent and that said Letters Patent is hereby corrected as shown below:

In column 4, claim 1, line 4, after "an" and before "elbow" the word --outer-- should be inserted.

Signed and Sealed this

Third Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,543,338 B2
APPLICATION NO. : 10/687228
DATED : June 9, 2009
INVENTOR(S) : Culhane It is certified that error appears in the above-identified patent and that said Letters Patent is hereby corrected as shown below:

In column 4, claim 1, line 24, after "an" and before "elbow" the word --outer-- should be inserted.

This certificate supersedes the Certificate of Correction issued November 3, 2009.

Signed and Sealed this

Twenty-fourth Day of November, 2009

David J. Kappos

David J. Kappos
*Director of the United States Patent and Trademark Office*